US012152213B2

(12) United States Patent
Akao

(10) Patent No.: US 12,152,213 B2
(45) Date of Patent: Nov. 26, 2024

(54) INDUSTRIAL OIL COMPOSITION

(71) Applicant: CITIZEN WATCH CO., LTD., Nishitokyo (JP)

(72) Inventor: Yuji Akao, Nishitokyo (JP)

(73) Assignee: CITIZEN WATCH CO., LTD., Nishitokyo (JP)

( * ) Notice: Subject to any disclaimer, the term of this patent is extended or adjusted under 35 U.S.C. 154(b) by 0 days.

(21) Appl. No.: 18/041,833

(22) PCT Filed: Aug. 31, 2021

(86) PCT No.: PCT/JP2021/032030
§ 371 (c)(1),
(2) Date: Feb. 16, 2023

(87) PCT Pub. No.: WO2022/054651
PCT Pub. Date: Mar. 17, 2022

(65) Prior Publication Data

US 2023/0340353 A1 Oct. 26, 2023

(30) Foreign Application Priority Data

Sep. 9, 2020 (JP) ..... 2020-151077

(51) Int. Cl.

| | |
|---|---|
| ***C10M 105/74*** | (2006.01) |
| ***C10M 141/10*** | (2006.01) |
| ***C10M 169/04*** | (2006.01) |
| ***C10N 30/06*** | (2006.01) |
| ***C10N 30/10*** | (2006.01) |
| ***C10N 40/02*** | (2006.01) |
| ***C10N 40/08*** | (2006.01) |
| ***C10N 40/22*** | (2006.01) |
| ***C10N 40/24*** | (2006.01) |
| ***C10N 40/30*** | (2006.01) |

(52) U.S. Cl.
CPC ..... *C10M 105/74* (2013.01); *C10M 141/10* (2013.01); *C10M 169/04* (2013.01); *C10M 2207/026* (2013.01); *C10M 2215/221* (2013.01); *C10M 2223/041* (2013.01); *C10M 2223/049* (2013.01); *C10N 2030/06* (2013.01); *C10N 2030/10* (2013.01); *C10N 2040/02* (2013.01); *C10N 2040/08* (2013.01); *C10N 2040/22* (2013.01); *C10N 2040/24* (2013.01); *C10N 2040/30* (2013.01)

(58) Field of Classification Search
CPC ..... C10M 105/74; C10M 141/10; C10M 169/04; C10M 2207/026; C10M 2215/221; C10M 223/041; C10M 223/049; C10N 2030/06; C10N 2030/10; C10N 2040/02; C10N 2040/08; C10N 2040/22; C10N 2040/24; C10N 2040/30
See application file for complete search history.

(56) References Cited

U.S. PATENT DOCUMENTS 5,892,097 A * 4/1999 Ross ..... C07C 67/03 560/75
9,738,848 B2 * 8/2017 Takata ..... C10M 137/04
(Continued)

FOREIGN PATENT DOCUMENTS

JP 01-247493 A 10/1989
JP 06-41572 A 2/1994
(Continued)

OTHER PUBLICATIONS

Japanese Notice of Reasons for Refusal for JP 2022-547521 dated Oct. 18, 2022.
(Continued)

*Primary Examiner* — James C Goloboy
(74) *Attorney, Agent, or Firm* — Sughrue Mion, PLLC

(57) ABSTRACT

An industrial oil composition contains a mineral or a synthetic oil as a base oil, and a neutral phosphite ester derivative represented by the following formula (B) and a 2,6-di-t-butylphenol derivative represented by the following formula (C) as antioxidants. In the formula (B), $R^{b21}$ to $R^{b24}$ each independently represent an aliphatic hydrocarbon group of 10 to 16 carbon atoms. In the formula (C), $R^{c1}$ represents a straight-chain or a branched alkyl group of 1 to 12 carbon atoms.

(B)

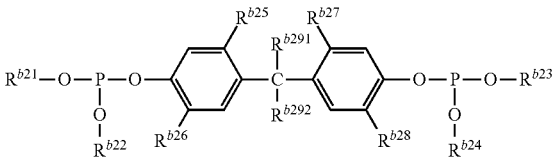

(C)

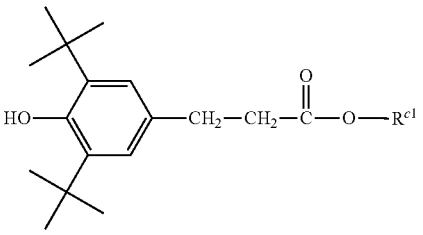

5 Claims, No Drawings

(56) References Cited

U.S. PATENT DOCUMENTS

| | | | | |
|---|---|---|---|---|
| 2015/0337233 | A1* | 11/2015 | Akao | C10M 169/04<br>508/438 |
| 2016/0122679 | A1 | 5/2016 | Takata et al. | |
| 2018/0371355 | A1* | 12/2018 | Matsumoto | C10M 133/44 |

FOREIGN PATENT DOCUMENTS

| | | | |
|---|---|---|---|
| JP | 06-192678 | A | 7/1994 |
| JP | 09-157681 | A | 6/1997 |
| JP | 2011-178990 | A | 9/2011 |
| JP | 2017-179197 | A | 10/2017 |
| JP | 2020-056447 | A | 4/2020 |
| WO | 2018/173555 | A1 | 9/2018 |
| WO | 2020/100430 | A1 | 5/2020 |

OTHER PUBLICATIONS

Japanese Decision to Grant a Patent for JP 2022-547521 dated Dec. 13, 2022.

International Search Report for PCT/JP2021/032030 dated Oct. 19, 2021.

Communication dated May 22, 2023 issued by the Intellectual Property India Patent Office in application No. 202347025214.

Communication dated Jun. 21, 2024 issued by the State Intellectual Property Office of the P.R.China in application No. 202180055072.4.

* cited by examiner

INDUSTRIAL OIL COMPOSITION

CROSS REFERENCE TO RELATED APPLICATIONS

This application is a National Stage of International Application No. PCT/JP2021/032030 filed Aug. 31, 2021, claiming priority based on Japanese Patent Application No. 2020-151077 filed Sep. 9, 2020, the entire contents of which are incorporated in their entirety.

FIELD

The present invention relates to an industrial oil composition.

BACKGROUND

In Patent Literature 1, a lubricating oil composition is described in which a hydrocarbon base oil selected from a mineral oil and a synthetic oil contains, on a total composition basis, (A) 0.008 to 0.04% by mass of a sarcosine acid derivative, (B) 0.01 to 0.07% by mass of an alkenyl succinate ester, (C) 0.1 to 3.0% by mass of an amine type antioxidant, and (D) 0.1 to 3.0% by mass of a phenolic type antioxidant.

CITATION LIST

Patent Literature

Patent Literature 1: Japanese Patent Application Laid-open No. 2017-179197

SUMMARY

Technical Problem

However, the lubricating oil composition according to Patent Literature 1 had the problem that this was not possible to be used for a long period of time.

Therefore, an object of the present invention is to provide an industrial oil composition that has a long life and can be used for a long period of time.

Solution to Problem

An industrial oil composition of the present invention includes a mineral or a synthetic oil as a base oil, and a neutral phosphite ester derivative represented by the following formula (B) and a 2,6-di-t-butylphenol derivative represented by the following formula (C) as antioxidants.

(B)

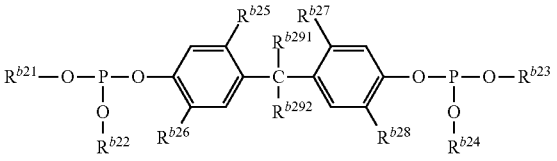

In the formula (B), $R^{b21}$ to $R^{b24}$ each independently represent an aliphatic hydrocarbon group of 10 to 16 carbon atoms, $R^{b25}$ to $R^{b28}$ each independently represent a straight-chain or branched alkyl group of 1 to 6 carbon atoms, $R^{b291}$ and $R^{b292}$ each independently represent a hydrogen atom or a straight-chain or branched alkyl group of 1 to 5 carbon atoms, and a total number of carbon atoms of $R^{b291}$ and $R^{b292}$ is 1 to 5.

(C)

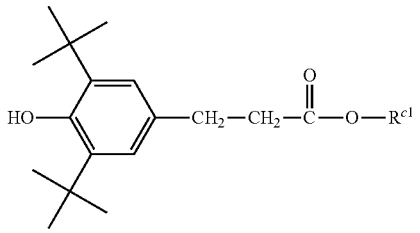

In the formula (C), $R^{c1}$ represents a straight-chain or branched alkyl group of 1 to 12 carbon atoms.

Advantageous Effects of Invention

The industrial oil composition according to the present invention has a long life and can be used for a long period of time.

DESCRIPTION OF EMBODIMENTS

Modes (embodiments) for implementing the present invention will be described in detail. The present invention is not limited by the content of the embodiments described below. The constituent elements described below include elements that can be easily thought of by a person skilled in the art and elements that are substantially identical. The configurations described below can also be combined, as appropriate. The configurations described below can also be variously omitted, substituted, and modified within a scope that does not deviate from the gist of the present invention.

Industrial Oil Composition According to First Embodiment

The industrial oil composition according to a first embodiment contains a synthetic oil as a base oil, and an antioxidant.

The synthetic oil used in the industrial oil composition according to the first embodiment contains a phosphate ester derivative, tris(isopropylphenyl) phosphate, and triphenyl phosphate. In this specification, these are also referred to as a first, a second, and a third component, respectively. The synthetic oil containing the first, second, and third components is flame retardant. Therefore, the industrial oil composition according to the first embodiment can also be used at a high temperature.

The phosphate ester derivative (first component, CAS 125997-21-9) has a repeating unit represented by the following formula (A1), with a structure represented by the following formula (A2) at one end, and a structure represented by the following formula (A3) at the other end. Specifically, in the phosphate derivative, one or more repeating units (A1) are repeated. The structure (A2) is bonded to one end, i.e., the benzene ring end of the structure (A1), and the structure (A3) is bonded to the other end, i.e., the O end of the structure (A1). In addition, the kinetic viscosity of the phosphate ester derivative at 40° C. (JIS K 2283) is in the range of not less than 100 cSt and not more than 200 cSt.

(A1)

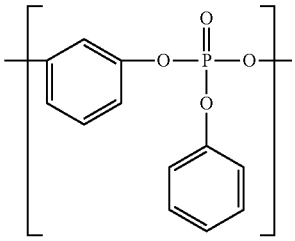

(A2)

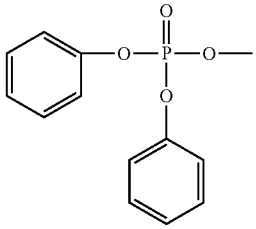

(A3)

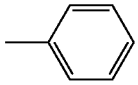

The phosphate derivative as described above has excellent flame retardant properties. Specifically, this can satisfy the following four requirements.

(1) Ignition point of the phosphate ester derivative is 550° C. or higher.

(2) The phosphate derivative heated to 400° C. does not continue to burn when brought into contact with a flame.

(3) The phosphate derivative heated to 400° C. does not continue to burn when a metal rod heated to 700° C. is immersed in it.

(4) The phosphate ester derivative does not continue to burn when a mist of the phosphate ester derivative is sprayed to a flame and when a mist of the phosphate ester derivative is sprayed to a metal rod heated to 700° C.

An example of the commercial product of the phosphate ester derivative that can be suitably used includes Adekastab PFR (registered trademark, manufactured by ADEKA Corp., kinematic viscosity at 40° C. of 147.3 cSt, flash point (JIS K 2265-4:2007) of 332° C., and no combustion point and no ignition point). This commercial product satisfies the above four requirements.

Tris(isopropylphenyl) phosphate (second component, isopropylphenyl phosphate: CAS 68937-41-7) and triphenyl phosphate (third component, triphenyl phosphate: CAS 115-86-6) are used to adjust the viscosity of the base oil. From the viewpoint of the viscosity adjustment, it is preferable that the second component be included in an amount of not less than 5% by mass and not more than 95% by mass, and the third component be included in an amount of not less than 5% by mass and not more than 95% by mass in the total 100% by mass of the second and third components. The second and third components are commercially available as the mixture thereof, and this mixture can be used. Examples of the commercial product as described above include a mixture containing 41% by mass of the second component (kinetic viscosity at 40° C. of 21 cSt (JIS K 2283), flash point of 256° C. (JIS K 2265-4:2007), combustion point of 320°, and no ignition point), and a mixture containing 24% by mass of the second component (kinetic viscosity at 40° C. of 26 cSt (JIS K 2283)).

From the viewpoint of flame retardance, it is preferable that the first component be contained in an amount of not less than 3% by mass and not more than 70% by mass in 100% by mass of the base oil. From the viewpoints of flame retardance, viscosity, and lubricity, it is preferable that the base oil (synthetic oil) be composed of the first component, the second component, and the third component, in which the first component is contained in an amount of not less than 3% by mass and not more than 70% by mass, and the second component and the third component are contained in a total amount of not less than 30% by mass and not more than 97% by mass, in 100% by mass of the base oil. The base oil may contain a component other than the first, second, and third components to the extent that they do not impair the flame retardance.

Examples of the antioxidant include a neutral phosphite ester derivative and a 2,6-di-t-butylphenol derivative. Because the above two types of antioxidants are used in combination, the antioxidant molecules are less likely to be destroyed when the industrial oil composition is used, thereby reducing the consumptions of the antioxidants. Consumptions of the antioxidants can be reduced compared to the case when the neutral phosphite ester derivative and 2,6-di-t-butylphenol derivative are used separately. Therefore, the capacity as the antioxidant used in the industrial oil composition can be sustained for a long period of time. In other words, the industrial oil composition has excellent oxidation stability, thereby suppressing the viscosity change and enabling to be used for a long period of time. The industrial oil composition according to the first embodiment can also be used at a high temperature because it contains the flame-retardant base oil. In the industrial oil composition to be used at a high temperature, it is important for this to have an antioxidant function. The combination of the above two types of antioxidants allows for the antioxidant function to be sustained over a long period of time, even when the industrial oil composition is used at a high temperature.

The neutral phosphite ester derivative is represented by the following formula (B). The neutral phosphite ester derivative may be used one kind alone or in a combination of two or more kinds thereof. Because the neutral phosphite ester derivative is a dimer, this is less likely to evaporate and can efficiently exhibit an antioxidant performance.

(B)

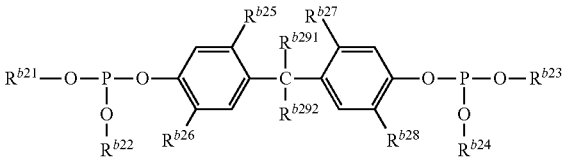

In the formula (B), $R^{b21}$ to $R^{b24}$ each independently represent an aliphatic hydrocarbon group of 10 to 16 carbon atoms.

Each of the aliphatic hydrocarbon groups of 10 to 16 carbon atoms may be a straight-chain, branched or cyclic aliphatic hydrocarbon group, and may be a saturated or unsaturated aliphatic hydrocarbon group. Specific examples of the aliphatic hydrocarbon group of 10 to 16 carbon atoms that can be preferably used include straight-chain alkyl groups, such as a decyl group, an undecyl group, a dodecyl group, a tridecyl group, a tetradecyl group, a pentadecyl group and a hexadecyl group (cetyl group).

$R^{b25}$ to $R^{b28}$ each independently represent a straight-chain or branched alkyl group of 1 to 6 carbon atoms.

Examples of the straight-chain or branched alkyl group of 1 to 6 carbon atoms include a methyl group, an ethyl group, an n-propyl group, an n-butyl group, an n-pentyl group, an n-hexyl group, an isopropyl group, a sec-butyl group, an isobutyl group, a t-butyl group, an isopentyl group, a t-pentyl group, a neopentyl group, and an isohexyl group.

Because the neutral phosphite ester has specific substituents in $R^{b25}$ to $R^{b28}$, the wear resistance, in addition to the antioxidant performance, is excellent. The reason for this improvement is thought to be because the film of the industrial composition applied to the sliding part is made strong by the specific substituents at $R^{b25}$ to $R^{b28}$.

Especially when $R^{b25}$ and $R^{b27}$ each are a straight-chain alkyl group of 1 to 6 carbon atoms, preferably 1 to 3 carbon atoms, and $R^{b26}$ and $R^{b28}$ each are a branched alkyl group of 3 to 6 carbon atoms, preferably 3 to 4 carbon atoms, the effect of improving the wear resistance is further enhanced.

$R^{b291}$ and $R^{b292}$ each independently represent a hydrogen atom or a straight-chain or branched alkyl group of 1 to 5 carbon atoms.

Examples of the straight-chain and branched alkyl group of 1 to 5 carbon atoms include a methyl group, an ethyl group, an n-propyl group, an n-butyl group, an n-pentyl group, an isopropyl group, a sec-butyl group, an isobutyl group, a t-butyl group, an isopentyl group, a t-pentyl group, and a neopentyl group.

However, the total number of carbon atoms of $R^{b291}$ and $R^{b292}$ is 1 to 5. Therefore, when $R^{b291}$ is, for example, a hydrogen atom, $R^{b292}$ is a straight-chain or branched alkyl group of 1 to 5 carbon atoms; when $R^{b291}$ is, for example, a methyl group, $R^{b292}$ is a straight-chain or branched alkyl group of 1 to 4 carbon atoms; and when $R^{b291}$ is, for example, an ethyl group, $R^{b292}$ is a straight-chain or branched alkyl group of 2 to 3 carbon atoms.

Because a film of the industrial oil composition is further strengthened, it is more preferable that $R^{b291}$ be a hydrogen atom and $R^{b292}$ be a straight-chain or branched alkyl group of 1 to 5 carbon atoms.

The 2,6-di-t-butylphenol derivative is represented by the following formula (C). The 2,6-di-t-butylphenol derivative may be used one kind alone or in a combination of two or more kinds thereof.

(C)

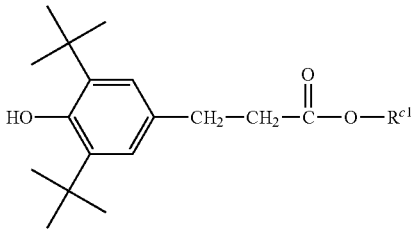

In the formula (C), $R^{c1}$ represents a straight-chain or branched alkyl group of 1 to 12 carbon atoms. Examples of the straight-chain or branched alkyl group of 1 to 12 carbon atoms include a methyl group, an ethyl group, an n-propyl group, an isopropyl group, an n-butyl group, a sec-butyl group, a t-butyl group, an iso-butyl group, an n-pentyl group, an iso-pentyl group, a t-pentyl group, a neopentyl group, a hexyl group, a heptyl group, an iso-heptyl group, an n-octyl group, an iso-octyl group, a 2-ethylhexyl group, a nonyl group, and a decyl group. The alkyl groups described above improve the compatibility of the 2,6-di-t-butylphenol derivative.

In the industrial oil composition according to the first embodiment, it is preferable that the neutral phosphite ester derivative be contained in an amount of not less than 0.001 parts by mass and not more than 5 parts by mass relative to 100 parts by mass of the base oil. It is preferable that the 2,6-di-t-butylphenol derivative be contained in an amount of not less than 0.001 parts by mass and not more than 5 parts by mass, relative to 100 parts by mass of the base oil. When the antioxidant is contained in the amount described above, the antioxidant performance can be sustained for a long period of time.

When the phosphate ester derivative is included in an amount of not more than 50% by mass in 100% by mass of the base oil, it may further contain a hindered amine compound as the antioxidant. When the phosphate derivative is contained in the above amount, the hindered amine compound can be properly mixed with the base oil. The use of the hindered amine compound can further enhance the antioxidant function of the industrial oil composition. In addition, the antioxidant function can be further enhanced even when the industrial oil composition is used at a high temperature.

The hindered amine compound is represented by the following formula (D). The hindered amine compound may be used one kind alone or in a combination of two or more kinds thereof.

(D)

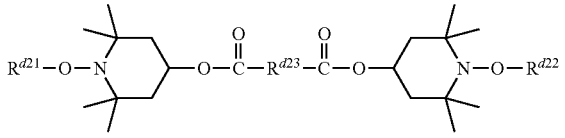

$R^{d21}$ and $R^{d22}$ each independently represent an aliphatic hydrocarbon group of 1 to 10 carbon atoms.

Each of the aliphatic hydrocarbon groups of 1 to 10 carbon atoms may be a straight-chain, branched or cyclic aliphatic hydrocarbon group, and may be a saturated or unsaturated aliphatic hydrocarbon group.

Specific examples of the aliphatic hydrocarbon group of 1 to 10 carbon atoms that can be preferably used include straight-chain and branched alkyl groups, such as a methyl group, an ethyl group, an n-propyl group, an n-butyl group, an n-pentyl group, an n-hexyl group, a heptyl group, an octyl group, a nonyl group, a decyl group, an isopropyl group, a sec-butyl group, an isobutyl group, a t-butyl group, an isopentyl group, a t-pentyl group, a neopentyl group, an isohexyl group, and a 2-ethylhexyl group. Among these, straight-chain and branched alkyl groups of 5 to 10 carbon atoms are more preferable from the viewpoint of enhanced durability.

$R^{d23}$ represents a divalent aliphatic hydrocarbon group of 1 to 10 carbon atoms.

Examples of the divalent aliphatic hydrocarbon group of 1 to 10 carbon atoms that can be preferably used include divalent straight-chain and branched alkylene groups, such as a methylene group, a 1,2-ethylene group, a 1,3-propylene group, a 1,4-butylene group, a 1,5-pentylene group, a 1,6-hexylene group, a 1,7-heptylene group, a 1,8-octylene group, a 1,9-nonylene group, a 1,10-decylene group, and a 3-methyl-1,5-pentylene group. Among these, a divalent straight-chain or branched alkylene group of 5 to 10 carbon atoms is more preferable from the viewpoint of enhanced durability.

From the viewpoint of enhanced durability at a high temperature, among the above groups the groups in which the total number of carbon atoms of $R^{d21}$, $R^{d22}$, and $R^{d23}$ is 16 to 30 are more preferable.

When the hindered amine compound is used in the industrial oil composition according to the first embodiment, it is preferable that this be contained in an amount of not less than 0.002 parts by mass and not more than 5 parts by mass relative to 100 parts by mass of the base oil.

The industrial oil composition according to the first embodiment may contain other additives. Examples of the other additive include an oiliness agent, an anti-wear agent, an extreme pressure agent, a metal deactivator, and a rust inhibitor. It is preferable that these additives be contained to the extent that they do not impair a long-term use at a high temperature in the industrial oil composition.

The industrial oil composition according to the first embodiment may be prepared by mixing the components described above in an appropriate way.

The industrial oil composition according to the first embodiment may be an industrial oil composition used for metal processing or for machine lubrication. Examples of the industrial oil composition used for metal processing include a cutting oil, a rolling oil, a pressed and drawing oil, a cleaning oil, a plastic processing oil, a punching oil, a heat treatment oil, and a thermal media oil. Examples of the industrial oil composition used for machine lubrication include a turbine oil, a hydraulic oil, a bearing oil, a gear oil, a compressor oil, and a traction oil. Because the industrial oil composition according to the first embodiment can be used at a high temperature for a long period of time, this is particularly suitable for the above applications where this is used at a high temperature for a long period of time. For example, this is particularly suitable as a turbine oil, a hydraulic fluid, and a rolling oil.

Industrial Oil Composition According to Second Embodiment

The industrial oil composition according to a second embodiment is different from the first embodiment in the base oil. That is, the industrial oil composition according to the second embodiment contains a mineral oil as the base oil, and antioxidants.

Examples of the mineral oil include a paraffinic base oil and naphthenic base oil. The mineral oil may be used one kind alone or in a combination of two or more kinds thereof.

In the industrial oil composition according to the second embodiment, too, the antioxidant includes the neutral phosphite ester derivative and the 2,6-di-t-butylphenol derivative. Because the above two types are used in combination as the antioxidant, consumption of the antioxidants can be reduced when the industrial oil composition is used. Therefore, the capacity as the antioxidant can be sustained over a long period of time. In other words, the industrial oil composition has excellent oxidation stability, thereby suppressing the viscosity change and enabling to be used for a long period of time. The details of the neutral phosphite ester derivative and 2,6-di-t-butylphenol derivative are the same as those described in the first embodiment.

In the industrial oil composition according to the second embodiment, the neutral phosphite ester derivative is preferably contained in an amount of not less than 0.001 parts by mass and not more than 5 parts by mass, relative to 100 parts by mass of the base oil. It is preferable that the 2,6-di-t-butylphenol derivative be contained in an amount of not less than 0.001 parts by mass and not more than 5 parts by mass, relative to 100 parts by mass of the base oil. When the antioxidant is contained in the amount described above, the antioxidant performance can be sustained for a long period of time.

This may further contain a hindered amine compound as the antioxidant. The use of the hindered amine compound can further enhance the antioxidant function of the industrial oil composition. The hindered amine compound can be suitably mixed with the mineral oil. The details of the hindered amine compound are the same as those described in the first embodiment.

When the hindered amine compound is used in the industrial oil composition according to the second embodiment, it is preferable that this be contained in an amount of not less than 0.002 parts by mass and not more than 5 parts by mass, relative to 100 parts by mass of the base oil.

The industrial oil composition according to the second embodiment may be prepared by mixing the components described above as appropriate.

The industrial oil composition according to the second embodiment may contain other additives. Specific examples of the other additive are the same as those described for the industrial oil composition according to the first embodiment. It is preferable that these be included to the extent that they do not impair the long-term use of the industrial oil composition.

The industrial oil composition according to the second embodiment may also be an industrial oil composition used for metal processing or an industrial oil composition used for machine lubrication. Specific examples of the industrial oil composition used for metal processing and of the industrial oil composition used for machine lubrication are the same as those described for the industrial oil composition according to the first embodiment. Because the industrial oil composition according to the second embodiment can be used over a long period of time, this is particularly suitable for use as a hydraulic fluid.

Industrial Oil Compositions According to Other Embodiments

Examples of the other embodiment include industrial oil compositions in which the base oil is different from those of the first and second embodiments. Examples of the industrial oil composition according to other embodiment include a synthetic oil other than the phosphate ester base oil used in the industrial oil composition according to the first embodiment and the antioxidant. Examples of the synthetic oil as described above include a paraffinic hydrocarbon oil, a polyol ester oil, and an ether oil.

The paraffinic hydrocarbon oil is preferably an α-olefin polymer having a carbon atom number of 30 or more, preferably in the range of 30 to 50. The paraffinic hydrocarbon oil may be used one kind alone or in a combination of two or more kinds thereof. The α-olefine polymer is, for example, a homopolymer of one monomer selected from ethylene and an α-olefin having 3 to 18 carbon atoms, preferably an α-olefin having 10 to 18 carbon atoms, and a copolymer of at least two or more monomers selected from ethylene and an α-olefin having 3 to 18 carbon atoms, preferably an α-olefin having 10 to 18 carbon atoms. Specifically, examples thereof include 1-decene trimer, 1-undecene trimer, 1-dodecene trimer, 1-tridecene trimer, 1-tetradecene trimer, and copolymer of 1-hexene with 1-pentene.

In addition, the paraffinic hydrocarbon oil having the kinetic viscosity at 100° C. in the range of not less than 4 cSt and not more than 6 cSt is preferable.

The polyol ester oil is preferably a polyol ester oil not having a hydroxyl group in its molecule. The polyol ester oil may be used one kind alone or in a combination of two or more kinds thereof.

The polyol ester oil as described above can be produced by causing to react a polyol having at least two hydroxyl groups in one molecule thereof with a monovalent acid or a salt thereof under the condition where the mixed molar ratio ((monovalent acid or salt thereof)/polyol) is not less than 1. In this case, the resulting polyol ester oil is a complete ester not having a hydroxyl group in its molecule.

Illustrative examples of the polyol described above include neopentyl glycol, trimethylolpropane, pentaerythritol, and dipentaerythritol. Illustrative examples of the monovalent acid include saturated aliphatic monocarboxylic acids such as acetic acid, propionic acid, butyric acid, isobutyric acid, valeric acid, pivalic acid, heptanoic acid, octanoic acid, nonanoic acid, decanoic acid, lauric acid, myristic acid, and palmitic acid; unsaturated aliphatic monocarboxylic acids such as stearic acid, acrylic acid, crotonic acid, and oleic acid; and cyclic carboxylic acids such as benzoic acid, toluyl acid, naphthoic acid, cinnamic acid, cyclohexanecarboxylic acid, nicotinic acid, isonicotinic acid, furan-2-carboxylic acid, pyrrol-N-carboxylic acid, monoethyl malonate, and ethyl hydrogen phthalate. Salts of the above monovalent acids include chlorides of the above monovalent acids.

Specific examples of the polyol ester oil include neopentyl glycol-decanoic/octanoic acids mixed ester, trimethylolpropane-valeric/heptanoic acids mixed ester, trimethylolpropane-decanoic/octanoic acids mixed ester, trimethylolpropane-nonanoic acid ester, and pentaerythritol-heptanoic/decanoic acids mixed ester.

From the viewpoint of preventing corrosion, it is preferable that the ether oil be an ether oil that does not have a hydroxyl group in its molecule; and an ether oil represented by the following formula (1) is more preferable. The ether oil may be used one kind alone or in a combination of two or more kinds thereof.

$$R^1\text{-}(O\text{-}R^2)_n\text{-}R^3 \quad (1)$$

In the formula (1), $R^1$ and $R^3$ each independently represent an alkyl group of 1 to 18 carbon atoms, or a monovalent aromatic hydrocarbon group of 6 to 18 carbon atoms. $R^2$ represents an alkylene group of 1 to 18 carbon atoms or a divalent aromatic hydrocarbon group of 6 to 18 carbon atoms. Here, n is an integer of 1 to 5.

Specifically, illustrative examples of the alkyl group of 1 to 18 carbon atoms include a methyl group, an ethyl group, a propyl group, an isopropyl group, an n-butyl group, an isobutyl group, a sec-butyl group, a tert-butyl group, an n-pentyl group, an isopentyl group, a tert-pentyl group, a neopentyl group, a hexyl group, an isohexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, and an octadecyl group. Specifically, illustrative examples of the monovalent aromatic hydrocarbon group of 6 to 18 carbon atoms include a phenyl group, a tolyl group, a xylyl group, a benzyl group, a phenethyl group, a 1-phenylethyl group, and a 1-methyl-1-phenylethyl group.

Specifically, illustrative examples of the alkylene group of 1 to 18 carbon atoms include a methylene group, an ethylene group, a propylene group, and a butylene group. Specifically, illustrative examples of the divalent aromatic hydrocarbon group of 6 to 18 carbon atoms include a phenylene group and a 1,2-naphthylene group.

In the industrial oil compositions according to other embodiments, too, the antioxidant includes the neutral ester phosphite derivative and the 2,6-di-t-butylphenol derivative. Because the above two types of the antioxidants are used in combination, the industrial oil composition is stabilized and the viscosity change thereof is suppressed, so that the composition can be used for a long period of time. The details of the neutral phosphite ester derivative and 2,6-di-t-butylphenol derivative are the same as those described in the first embodiment. The preferable amounts of the neutral phosphite ester derivative and 2,6-di-t-butylphenol derivative in the industrial oil composition according to the other embodiments and the reasons for such are also the same as those in the first embodiment.

The industrial oil composition according to the other embodiments, too, may further contain the hindered amine compound as the antioxidant. The use of the hindered amine compound can further enhance the antioxidant function of the industrial oil composition. The details of the hindered amine compound are the same as those described in the first embodiment. The preferable amount of the hindered amine compound in the industrial oil composition according to the other embodiments is also the same as in the first embodiment.

The industrial oil composition according to the other embodiments may also contain other additives. Specific examples of the other additive are the same as those described for the industrial oil composition according to the first embodiment. It is preferable that these be included to the extent that they do not impair the long-term use of the industrial oil composition.

The industrial oil composition according to the other embodiment, too, may be an industrial oil composition used for metal processing or an industrial oil composition used for machine lubrication. Specific examples of the industrial oil composition used for metal processing and of the industrial oil composition used for machine lubrication are the same as those described for the industrial oil composition according to the first embodiment.

In light of the above description, the present invention relates to the following.

[1] An industrial oil composition containing a mineral or a synthetic oil as a base oil, and a neutral phosphite ester derivative represented by the following formula (B) and a 2,6-di-t-butylphenol derivative represented by the following formula (C) as antioxidants.

(B)

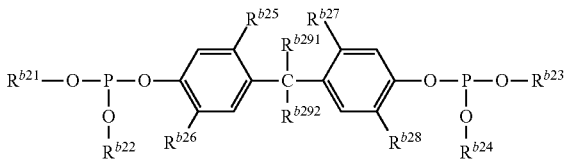

(In the formula (B), $R^{b21}$ to $R^{b24}$ each independently represent an aliphatic hydrocarbon group of 10 to 16 carbon atoms, $R^{b25}$ to $R^{b28}$ each independently represent a straight-chain or branched alkyl group of 1 to 6 carbon atoms, $R^{b291}$ and $R^{b292}$ each independently represent a hydrogen atom or a straight-chain or branched alkyl group of 1 to 5 carbon atoms, and the total number of carbon atoms of $R^{b291}$ and $R^{b292}$ is 1 to 5.)

(C)

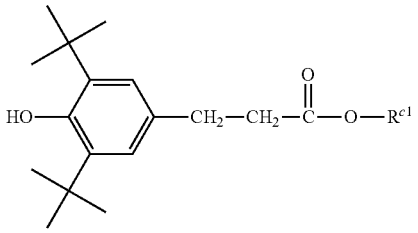

(In the formula (C), $R^{c1}$ represents a straight-chain or branched alkyl group of 1 to 12 carbon atoms.)

The industrial oil composition according to [1] above has a long life and can be used for a long period of time.

[2] The industrial oil composition according to [1], in which the base oil is a synthetic oil, the synthetic oil contains a phosphate ester derivative, tris(isopropylphenyl) phosphate, and triphenyl phosphate, the phosphate ester derivative has a repeating unit represented by the following formula (A1), a structure represented by the following formula (A2) at one end, and a structure represented by the following formula (A3) at the other end, and a kinetic viscosity at 40° C. is in the range of not less than 100 cSt and not more than 200 cSt.

(A1)

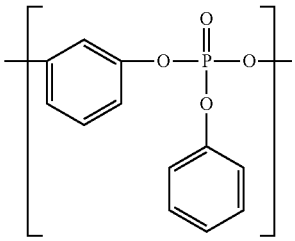

(A2)

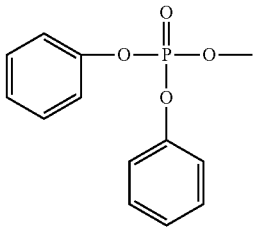

(A3)

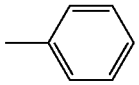

The industrial oil composition according to [2] can be used for a long period of time at a high temperature.

[3] The industrial oil composition according to [2], in which the phosphate ester derivative is included in an amount of not more than 50% by mass when the total of the synthetic oil accounts for 100% by mass, and the industrial oil composition further contains a hindered amine compound represented by the following formula (D) as the antioxidant.

(D)

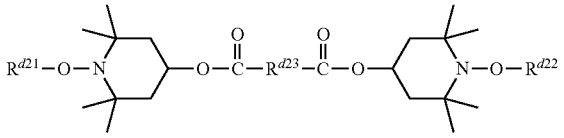

(In the formula (D), $R^{d21}$ and $R^{d22}$ each independently represent an aliphatic hydrocarbon group of 1 to 10 carbon atoms, and $R^{d23}$ represents a divalent aliphatic hydrocarbon group of 1 to 10 carbon atoms.)

The industrial oil composition according to [3] has a further improved antioxidant function even when used at a high temperature.

[4] The industrial oil composition according to [1], in which the base oil is a mineral oil, and the industrial oil composition further contains a hindered amine compound represented by the following formula (D) as the antioxidant.

(D)

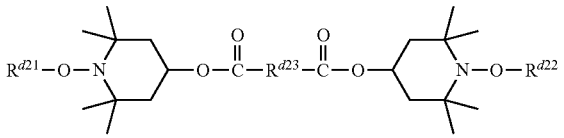

(In the formula (D), $R^{d21}$ and $R^{d22}$ each independently represent an aliphatic hydrocarbon group of 1 to 10 carbon atoms, and $R^{d23}$ represents a divalent aliphatic hydrocarbon group of 1 to 10 carbon atoms.)

The industrial oil composition according to [4] has a further improved antioxidant function.

EXAMPLES

The present invention will be described more specifically based on the following examples, but the invention is not limited to these examples.

Example 1-1-1

A synthetic oil was used as the base oil, containing 60% by mass of a phosphate ester derivative (first component, CAS 125997-21-9, trade name: Adekastab (registered trademark) PFR, manufactured by ADEKA Corp.; kinetic viscosity of 147.3 cSt at 40° C. (JIS K 2283)) and 40% by mass of a mixture of tris(isopropylphenyl) phosphate (second component, CAS 68937-41-7) and triphenyl phosphate (third component, CAS 115-86-6) (trade name: Reofos 35, manufactured by Ajinomoto Fine-Techno Co. Ltd., containing 41% by mass of the second component in the mixture; kinetic viscosity of 21 cSt at 40° C. (JIS K 2283); flash point of 256° C. (JIS K 2265-4:2007); combustion point of 320° C.; no ignition point).

To 100 parts by mass of this synthetic oil, 0.1 parts by mass of 4,4'-butylidenebis(3-methyl-6-t-butylphenyl ditridecyl phosphite) as the neutral phosphite ester derivative, and as the 2,6-di-t-butylphenol derivative 0.1 parts by mass of octyl=3-(3,5-di-tert-butyl-4-hydroxyphenyl) propanoate (CAS 125643-61-0, trade name: Irganox (registered trademark) L135, manufactured by BASF Japan Co. Ltd.) were mixed to obtain the industrial oil composition.

Example 1-1-2

The industrial oil composition was obtained in the same way as Example 1-1-1 except that in place of a mixture of tris(isopropylphenyl) phosphate and triphenyl phosphate (trade name: Reofos 35, manufactured by Ajinomoto Fine-Techno Co., Ltd.), a mixture of tris(isopropylphenyl) phosphate (second component, CAS 68937-41-7) and triphenyl phosphate (third component, CAS 115-86-6) (trade name: Reofos 65, manufactured by Ajinomoto Fine-Techno Co., Ltd., containing 24% by mass of the second component in the mixture; kinetic viscosity of 26 cSt at 40° C. (JIS K 2283)) was used.

Examples 1-1-3 to 1-1-8

The industrial oil compositions were obtained in the same way as Example 1-1-1 except that in place of 4,4'-butylidenebis(3-methyl-6-t-butylphenyl ditridecyl phosphite) ($R^{b21}$ to $R^{b24}$=tridecyl group, $R^{b25}$ and $R^{b27}$=methyl group, $R^{b26}$ and $R^{b28}$=t-butyl group, $R^{b291}$=hydrogen atom, and $R^{b292}$=n-propyl group), the compounds in Table 1 were used as the neutral phosphite ester derivative.

TABLE 1

| Example | $R^{b21}$ to $R^{b24}$ | $R^{b25}$, $R^{b27}$ | $R^{b26}$, $R^{b28}$ | $R^{b291}$ | $R^{b292}$ |
|---|---|---|---|---|---|
| 1-1-3 | Decyl group | Methyl group | t-Butyl group | Hydrogen atom | n-Propyl group |
| 1-1-4 | Hexadecyl group | Methyl group | t-Butyl group | Hydrogen atom | n-Propyl group |
| 1-1-5 | Tridecyl group | n-Propyl group | t-Butyl group | Hydrogen atom | n-Propyl group |
| 1-1-6 | Tridecyl group | Methyl group | Isobutyl group | Hydrogen atom | n-Propyl group |
| 1-1-7 | Tridecyl group | Methyl group | t-Butyl group | Hydrogen atom | n-Pentyl group |
| 1-1-8 | Tridecyl group | Methyl group | t-Butyl group | Ethyl group | n-Propyl group |

Example 1-1-9

The industrial oil composition was obtained in the same way as Example 1-1-1, except that in place of 0.1 parts by mass of the neutral phosphite ester derivative relative to 100 parts by mass of the synthetic oil, 0.001 parts by mass of the neutral phosphite ester derivative was used.

Example 1-1-10

The industrial oil composition was obtained in the same way as Example 1-1-1, except that in place of 0.1 parts by mass of the neutral phosphite ester derivative relative to 100 parts by mass of the synthetic oil, 5 parts by mass of the neutral phosphite ester derivative was used.

Example 1-1-11

The industrial oil composition was obtained in the same way as Example 1-1-1, except that in place of 0.1 parts by mass of the 2,6-di-t-butylphenol derivative relative to 100 parts by mass of the synthetic oil, 0.001 parts by mass of the 2,6-di-t-butylphenol derivative was used.

Example 1-1-12

The industrial oil composition was obtained in the same way as Example 1-1-1, except that in place of 0.1 parts by mass of the 2,6-di-t-butylphenol derivative relative to 100 parts by mass of the synthetic oil, 5 parts by mass of the 2,6-di-t-butylphenol derivative was used.

Example 1-2-1

A synthetic oil was used as the base oil, containing 50% by mass of a phosphate ester derivative (first component, CAS 125997-21-9, trade name: Adekastab (registered trademark) PFR, manufactured by ADEKA Corp.; kinetic viscosity of 147.3 cSt at 40° C. (JIS K 2283)) and 50% by mass of a mixture of tris(isopropylphenyl) phosphate (second component, CAS 68937-41-7) and triphenyl phosphate (third component, CAS 115-86-6) (trade name: Reofos 35, manufactured by Ajinomoto Fine-Techno Co. Ltd., containing 41% by mass of the second component in the mixture; kinetic viscosity of 21 cSt at 40° C. (JIS K 2283); flash point of 256° C. (JIS K 2265-4:2007); combustion point of 320° C.; no ignition point).

To 100 parts by mass of this synthetic oil, 0.1 parts by mass of 4,4'-butylidenebis(3-methyl-6-t-butylphenyl ditridecyl phosphite) as the neutral phosphite ester derivative, and as the 2,6-di-t-butylphenol derivative 0.1 parts by mass of octyl=3-(3,5-di-tert-butyl-4-hydroxyphenyl) propanoate (CAS 125643-61-0, trade name: Irganox (registered trademark) L135, manufactured by BASF Japan Co. Ltd.), and as the hindered amine compound 0.1 parts by mass of decanedioic acid bis(2,2,6,6-tetramethyl-1-(octyloxy) piperidin-4-yl) were mixed to obtain the industrial oil composition.

Example 1-2-2

The industrial oil composition was obtained in the same way as Example 1-2-1 except that in place of a mixture of tris(isopropylphenyl) phosphate and triphenyl phosphate (trade name: Reofos 35, manufactured by Ajinomoto Fine-Techno Co., Ltd.), a mixture of tris(isopropylphenyl) phosphate (second component, CAS 68937-41-7) and triphenyl phosphate (third component, CAS 115-86-6) (trade name: Reofos 65, manufactured by Ajinomoto Fine-Techno Co., Ltd., containing 24% by mass of the second component in the mixture; kinetic viscosity of 26 cSt at 40° C. (JIS K 2283)) was used.

Examples 1-2-3 to 1-2-8

The industrial oil compositions were obtained in the same way as Example 1-2-1 except that in place of 4,4'-butylidenebis(3-methyl-6-t-butylphenyl ditridecyl phosphite) ($R^{b21}$ to $R^{b24}$=tridecyl group, $R^{b25}$ and $R^{b27}$=methyl group, $R^{b26}$ and $R^{b28}$=t-butyl group, $R^{b291}$=hydrogen atom, and $R^{b292}$=n-propyl group), the compounds in Table 2 were used as the neutral phosphite ester derivative.

TABLE 2

| Example | $R^{b21}$ to $R^{b24}$ | $R^{b25}$, $R^{b27}$ | $R^{b26}$, $R^{b28}$ | $R^{b291}$ | $R^{b292}$ |
|---|---|---|---|---|---|
| 1-2-3 | Decyl group | Methyl group | t-Butyl group | Hydrogen atom | n-Propyl group |
| 1-2-4 | Hexadecyl group | Methyl group | t-Butyl group | Hydrogen atom | n-Propyl group |
| 1-2-5 | Tridecyl group | n-Propyl group | t-Butyl group | Hydrogen atom | n-Propyl group |
| 1-2-6 | Tridecyl group | Methyl group | Isobutyl group | Hydrogen atom | n-Propyl group |

TABLE 2-continued

| Example | $R^{b21}$ to $R^{b24}$ | $R^{b25}$, $R^{b27}$ | $R^{b26}$, $R^{b28}$ | $R^{b291}$ | $R^{b292}$ |
|---|---|---|---|---|---|
| 1-2-7 | Tridecyl group | Methyl group | t-Butyl group | Hydrogen atom | n-Pentyl group |
| 1-2-8 | Tridecyl group | Methyl group | t-Butyl group | Ethyl group | n-Propyl group |

Example 1-2-9

The industrial oil composition was obtained in the same way as Example 1-2-1, except that in place of 0.1 parts by mass of the neutral phosphite ester derivative relative to 100 parts by mass of the synthetic oil, 0.001 parts by mass of the neutral phosphite ester derivative was used.

Example 1-2-10

The industrial oil composition was obtained in the same way as Example 1-2-1, except that in place of 0.1 parts by mass of the neutral phosphite ester derivative relative to 100 parts by mass of the synthetic oil, 5 parts by mass of the neutral phosphite ester derivative was used.

Example 1-2-11

The industrial oil composition was obtained in the same way as Example 1-2-1, except that in place of 0.1 parts by mass of the 2,6-di-t-butylphenol derivative relative to 100 parts by mass of the synthetic oil, 0.001 parts by mass of the 2,6-di-t-butylphenol derivative was used.

Example 1-2-12

The industrial oil composition was obtained in the same way as Example 1-2-1, except that in place of 0.1 parts by mass of the 2,6-di-t-butylphenol derivative relative to 100 parts by mass of the synthetic oil, 5 parts by mass of the 2,6-di-t-butylphenol derivative was used.

Examples 1-2-13 to 1-2-18

The industrial oil compositions were obtained in the same way as Example 1-2-1, except that in place of the hindered amine compound, bis(2,2,6,6-tetramethyl-1-(octyloxy) piperidin-4-yl decanedioic acid ($R^{d21}$ and $R^{d22}$=n-octyl group, $R^{d23}$=1,8-octylene group), the compounds in Table 3 were used.

TABLE 3

| Example | $R^{d21}$, $R^{d22}$ | $R^{d23}$ |
|---|---|---|
| 1-2-13 | Methyl group | Methylene group |
| 1-2-14 | n-Propyl group | 1,3-Propylene group |
| 1-2-15 | n-Pentyl group | 1,5-Pentylene group |
| 1-2-16 | n-Pentyl group | 1,5-Pentylene group |
| 1-2-17 | n-Hexyl group | 1,6-Hexylene group |
| 1-2-18 | n-Decyl group | 1,10-Decylene group |

Example 1-2-19

The industrial oil composition was obtained in the same way as Example 1-2-1, except that in place of 0.1 parts by mass of the hindered amine compound relative to 100 parts by mass of the synthetic oil, 0.002 parts by mass of the hindered amine compound was used.

Example 1-2-20

The industrial oil composition was obtained in the same way as Example 1-2-1, except that in place of 0.1 parts by mass of the hindered amine relative to 100 parts by mass of the synthetic oil, 5 parts by mass of the hindered amine was used.

Example 2-1-1

To 100 parts by mass of mineral oil (trade name: 350NEUTRAL, manufactured by ENEOS Corp.), 0.1 parts by mass of 4,4'-butylidenebis(3-methyl-6-t-butylphenyl ditridecyl phosphite) as the neutral phosphite ester derivative, and as the 2,6-di-tert-butylphenol derivative 0.1 parts by mass of octyl=3-(3,5-di-tert-butyl-4-hydroxyphenyl) propanoate (CAS 125643-61-0, trade name: Irganox (registered trademark) L135, manufactured by BASF Japan Co. Ltd.) were mixed to obtain the industrial oil composition.

Example 2-1-2

The industrial oil composition was obtained in the same way as Example 2-1-1, except that in place of 0.1 parts by mass of the neutral phosphite ester derivative relative to 100 parts by mass of the mineral oil, 0.001 parts by mass of the neutral phosphite ester derivative was used.

Example 2-1-3

The industrial oil composition was obtained in the same way as Example 2-1-1, except that in place of 0.1 parts by mass of the neutral phosphite ester derivative relative to 100 parts by mass of the mineral oil, 5 parts by mass of the neutral phosphite ester derivative was used.

Example 2-1-4

The industrial oil composition was obtained in the same way as Example 2-1-1, except that in place of 0.1 parts by mass of the 2,6-di-t-butylphenol derivative relative to 100 parts by mass of the mineral oil, 0.001 parts by mass of the 2,6-di-t-butylphenol derivative was used.

Example 2-1-5

The industrial oil composition was obtained in the same way as Example 2-1-1, except that in place of 0.1 parts by mass of the 2,6-di-t-butylphenol derivative relative to 100 parts by mass of the mineral oil, 5 parts by mass of the 2,6-di-t-butylphenol derivative was used.

Example 2-2-1

To 100 parts by mass of mineral oil (trade name: 350NEUTRAL, manufactured by ENEOS Corp), 0.1 parts by mass of 4,4'-butylidenebis(3-methyl-6-t-butylphenyl ditridecyl phosphite), and as the 2,6-di-t-butylphenol derivative 0.1 parts by mass of octyl=3-(3,5-di-tert-butyl-4-hydroxyphenyl) propanoate (CAS 125643-61-0, trade name: Irganox (registered trademark) L135, manufactured by BASF Japan Co. Ltd.), and as the hindered amine compound 0.1 parts by mass of decanedioic acid bis(2,2,6,6-tetramethyl-1-(octyloxy) piperidin-4-yl) were mixed to obtain the industrial oil composition.

Example 2-2-2

The industrial oil composition was obtained in the same way as Example 2-2-1, except that in place of 0.1 parts by mass of the neutral phosphite ester derivative relative to 100 parts by mass of the mineral oil, 0.001 parts by mass of the neutral phosphite ester derivative was used.

Example 2-2-3

The industrial oil composition was obtained in the same way as Example 2-2-1, except that in place of 0.1 parts by mass of the neutral phosphite ester derivative relative to 100 parts by mass of the mineral oil, 5 parts by mass of the neutral phosphite ester derivative was used.

Example 2-2-4

The industrial oil composition was obtained in the same way as Example 2-2-1, except that in place of 0.1 parts by mass of the 2,6-di-t-butylphenol derivative relative to 100 parts by mass of the mineral oil, 0.001 parts by mass of the 2,6-di-t-butylphenol derivative was used.

Example 2-2-5

The industrial oil composition was obtained in the same way as Example 2-2-1, except that in place of 0.1 parts by mass of the 2,6-di-t-butylphenol derivative relative to 100 parts by mass of the mineral oil, 5 parts by mass of the 2,6-di-t-butylphenol derivative was used.

Example 2-2-6

The industrial oil composition was obtained in the same way as Example 2-2-1, except that in place of 0.1 parts by mass of the hindered amine compound relative to 100 parts by mass of the synthetic oil, 0.002 parts by mass of the hindered amine compound was used.

Example 2-2-7

The industrial oil composition was obtained in the same way as Example 2-2-1, except that in place of 0.1 parts by mass of the hindered amine compound relative to 100 parts by mass of the mineral oil, 5 parts by mass of the hindered amine compound was used.

[Evaluation Method and Results]

First, two cylindrical discs (diameter of 30 mm, thickness of 5 mm, made of SUJ2) were prepared. The industrial oil composition obtained in Example was applied to the bottom surface of one disc, and the bottom surface of the other disc was overlaid on the applied industrial oil composition. Into the industrial oil composition obtained in Example in a container heated at 80° C., the two discs overlapped were immersed with the bottoms of the discs perpendicular to the ground. Next, one disk was then rotated at 1000 rpm for 3 or 6 hours while the other disk was pressed against the one disk with a pressure of 150 kg. The industrial oil composition was thus subjected to a thermal history of 3 or 6 hours.

Next, the friction coefficient of the industrial oil composition that had been subjected to a 3-hour or 6-hour thermal history was determined by a pendulum friction test. Specifically, the industrial oil composition in the container combined with the industrial oil composition present between the discs after 3 or 6 hours of rotation was used for the pendulum friction test. The friction coefficient was also determined in the same way for the industrial oil compositions obtained in Example in the as-made condition (without thermal history).

The results are summarized in Table 4.

TABLE 4

| | Thermal history | | |
|---|---|---|---|
| Example | without thermal history | 3 hours | 6 hours |
| 1-1-1 | 0.11 | 0.11 | 0.13 |
| 1-1-2 | 0.11 | 0.11 | 0.13 |
| 1-1-3 | 0.11 | 0.11 | 0.13 |
| 1-1-4 | 0.11 | 0.11 | 0.13 |
| 1-1-5 | 0.11 | 0.11 | 0.13 |
| 1-1-6 | 0.11 | 0.11 | 0.13 |
| 1-1-7 | 0.11 | 0.11 | 0.13 |
| 1-1-8 | 0.11 | 0.11 | 0.13 |
| 1-1-9 | 0.11 | 0.11 | 0.13 |
| 1-1-10 | 0.11 | 0.11 | 0.13 |
| 1-1-11 | 0.11 | 0.11 | 0.13 |
| 1-1-12 | 0.11 | 0.11 | 0.13 |
| 1-2-1 | 0.11 | 0.11 | 0.11 |
| 1-2-2 | 0.11 | 0.11 | 0.11 |
| 1-2-3 | 0.11 | 0.11 | 0.11 |
| 1-2-4 | 0.11 | 0.11 | 0.11 |
| 1-2-5 | 0.11 | 0.11 | 0.11 |
| 1-2-6 | 0.11 | 0.11 | 0.11 |
| 1-2-7 | 0.11 | 0.11 | 0.11 |
| 1-2-8 | 0.11 | 0.11 | 0.11 |
| 1-2-9 | 0.11 | 0.11 | 0.11 |
| 1-2-10 | 0.11 | 0.11 | 0.11 |
| 1-2-11 | 0.11 | 0.11 | 0.11 |
| 1-2-12 | 0.11 | 0.11 | 0.11 |
| 1-2-13 | 0.11 | 0.11 | 0.11 |
| 1-2-14 | 0.11 | 0.11 | 0.11 |
| 1-2-15 | 0.11 | 0.11 | 0.11 |
| 1-2-16 | 0.11 | 0.11 | 0.11 |
| 1-2-17 | 0.11 | 0.11 | 0.11 |
| 1-2-18 | 0.11 | 0.11 | 0.11 |
| 1-2-19 | 0.11 | 0.11 | 0.11 |
| 1-2-20 | 0.11 | 0.11 | 0.11 |
| 2-1-1 | 0.12 | 0.12 | 0.17 |
| 2-1-2 | 0.12 | 0.12 | 0.17 |
| 2-1-3 | 0.12 | 0.12 | 0.17 |
| 2-1-4 | 0.12 | 0.12 | 0.17 |
| 2-1-5 | 0.12 | 0.12 | 0.17 |
| 2-2-1 | 0.12 | 0.12 | 0.12 |
| 2-2-2 | 0.12 | 0.12 | 0.12 |
| 2-2-3 | 0.12 | 0.12 | 0.12 |
| 2-2-4 | 0.12 | 0.12 | 0.12 |
| 2-2-5 | 0.12 | 0.12 | 0.12 |
| 2-2-6 | 0.12 | 0.12 | 0.12 |
| 2-2-7 | 0.12 | 0.12 | 0.12 |

The industrial oil compositions in Examples exhibit that the friction coefficient is kept low even after a long thermal history, indicating that these can be used for a long period of time. The use of the hindered amine compound also exhibits that the friction coefficient is kept further low after a long thermal history, indicating that the composition can be used for a longer period of time. When the synthetic oil containing the phosphate ester derivative and the like is used, the friction coefficient is further lowered even after a long thermal history, indicating that the composition can be used for a long period of time even at a high temperature.

The invention claimed is:

1. An industrial oil composition, comprising;

a mineral or a synthetic oil as a base oil, and a neutral phosphite ester derivative represented by the following formula (B) and a 2,6-di-t-butylphenol derivative represented by the following formula (C) as antioxidants:

(B)

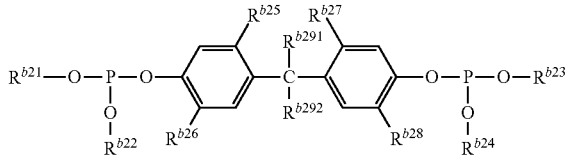

in the formula (B), $R^{b21}$ to $R^{b24}$ each independently represent an aliphatic hydrocarbon group of 10 to 16 carbon atoms, $R^{b25}$ to $R^{b28}$ each independently represent a straight-chain or branched alkyl group of 1 to 6 carbon atoms, $R^{b291}$ and $R^{b292}$ each independently represent a hydrogen atom or a straight-chain or branched alkyl group of 1 to 5 carbon atoms, and a total number of carbon atoms of $R^{b291}$ and $R^{b292}$ is 1 to 5, (C)

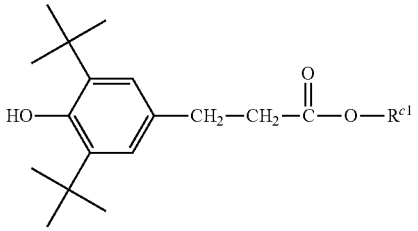

in the formula (C), $R^{c1}$ represents a straight-chain or branched alkyl group of 1 to 12 carbon atoms, wherein the synthetic oil comprises a phosphate ester derivative, tris(isopropylphenyl) phosphate, and triphenyl phosphate, the phosphate ester derivative has a repeating unit represented by the following formula (A1), a structure represented by the following formula (A2) at one end, and a structure represented by the following formula (A3) at another end, and a kinematic viscosity at 40° C. is in a range of not less than 100 cSt and not more than 200 cSt:

(A1)

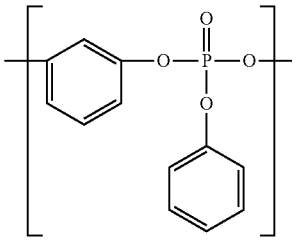

-continued (A2)

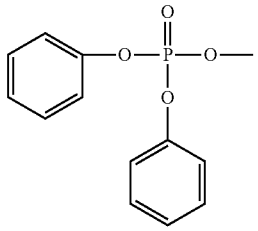

(A3)

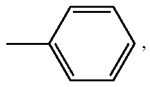

and triphenyl phosphate is present in an amount of 1.5% to 92.15% by mass of the synthetic oil.

2. The industrial oil composition according to claim 1, wherein the base oil is the synthetic oil, and triphenyl phosphate is present in an amount of 23.6% to 92.15% by mass of the synthetic oil.

3. The industrial oil composition according to claim 2, wherein the phosphate ester derivative is present in an amount of not more than 50% by mass of the synthetic oil, and the industrial oil composition further includes a hindered amine compound represented by the following formula (D) as the antioxidant:

(D)

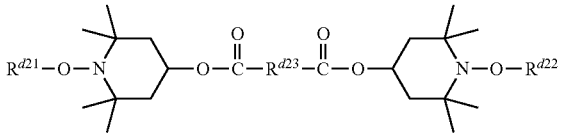

in the formula (D), $R^{d21}$ and $R^{d22}$ each independently represent an aliphatic hydrocarbon group of 1 to 10 carbon atoms, and $R^{d23}$ represents a divalent aliphatic hydrocarbon group of 1 to 10 carbon atoms.

4. The industrial oil composition according to claim 1, wherein the base oil is a mineral oil, and the industrial oil composition further includes a hindered amine compound represented by the following formula (D) as the antioxidant:

(D)

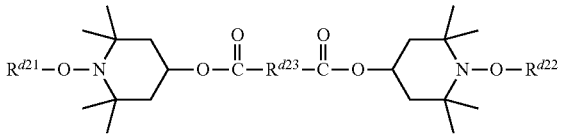

in the formula (D), $R^{d21}$ and $R^{d22}$ each independently represent an aliphatic hydrocarbon group of 1 to 10 carbon atoms, and $R^{d23}$ represents a divalent aliphatic hydrocarbon group of 1 to 10 carbon atoms.

5. The industrial oil composition according to claim 1, wherein the base oil is a synthetic oil, and the synthetic oil consists of a phosphate ester derivative, tris(isopropylphenyl) phosphate, and triphenyl phosphate.

* * * * *